US007114618B2

(12) United States Patent
Arnold

(10) Patent No.: US 7,114,618 B2
(45) Date of Patent: Oct. 3, 2006

(54) FOLDABLE FOAM PACKING ELEMENT

(75) Inventor: Mark Hanley Arnold, Conyers, GA (US)

(73) Assignee: SCA North America-Packaging Division, Inc., Eddystone, PA (US)

( * ) Notice: Subject to any disclaimer, the term of this patent is extended or adjusted under 35 U.S.C. 154(b) by 107 days.

(21) Appl. No.: 10/699,739

(22) Filed: Nov. 4, 2003

(65) Prior Publication Data

US 2005/0092645 A1 May 5, 2005

(51) Int. Cl.
*B65D 85/30* (2006.01)
*B65D 81/02* (2006.01)
*B65B 23/00* (2006.01)

(52) U.S. Cl. ..... 206/523; 206/454; 206/590; 206/592; 53/472

(58) Field of Classification Search ..... 206/523, 206/521, 583–594, 454; 53/472–474
See application file for complete search history.

(56) References Cited

U.S. PATENT DOCUMENTS

| | | | | | |
|---|---|---|---|---|---|
| 1,808,833 | A | | 6/1931 | Brack | |
| 2,561,260 | A | | 7/1951 | Yaupp | |
| 3,564,811 | A | * | 2/1971 | Freeman | 206/523 |
| 3,854,650 | A | * | 12/1974 | Hanaue | 206/521 |
| 3,939,978 | A | | 2/1976 | Thomaswick | |
| 3,987,956 | A | * | 10/1976 | Congleton | 206/523 |
| 4,027,817 | A | | 6/1977 | Fremion | |
| 4,122,946 | A | * | 10/1978 | Holley | 206/523 |
| 4,840,277 | A | * | 6/1989 | Waldner | 206/523 |
| 4,883,179 | A | * | 11/1989 | Dionne | 206/523 |
| 4,892,193 | A | | 1/1990 | Thomas | |
| 4,972,954 | A | * | 11/1990 | Dickie | 206/523 |
| 5,024,328 | A | * | 6/1991 | Bontrager | 206/523 |
| 5,207,327 | A | * | 5/1993 | Brondos | 206/523 |
| 5,223,121 | A | | 6/1993 | Dickie et al. | |
| 5,522,539 | A | | 6/1996 | Bazany | |
| 6,508,362 | B1 | | 1/2003 | Hnatow et al. | |
| 6,868,965 | B1 | * | 3/2005 | Miller et al. | 206/591 |

FOREIGN PATENT DOCUMENTS

| | | | |
|---|---|---|---|
| EP | 341838 | A1 * | 11/1989 |
| GB | 2042459 | A * | 9/1980 |
| GB | 2081678 | A * | 2/1982 |

* cited by examiner

*Primary Examiner*—Bryon Gehman
(74) *Attorney, Agent, or Firm*—Buchanan Ingersoll & Rooney, PC

(57) ABSTRACT

A unitary foam packing element including a planar piece of foam which is precut with a plurality of score lines. The score lines define a first planar portion and a second planar portion, and enable the first planar portion to be folded over onto the second planar portion to thereby form a flat cavity between the first planar portion and the second planar portion. The score lines further define an end panel adjacent the second planar portion, which is adapted to be folded along a respective one of the score lines so as to form a first end wall of the flat cavity, and an intermediate portion between the first planar portion and the second planar portion, which is adapted to form a second end wall of the flat cavity that is opposite the first end wall.

11 Claims, 6 Drawing Sheets

FOLDABLE FOAM PACKING ELEMENT

TECHNICAL FIELD

The present invention is directed to a packing system for substantially planar articles, and more particularly to a unitary packing system that is foldable about a plurality of scored hinge lines so as to thereby form a protected flat cavity area.

BACKGROUND OF THE INVENTION

Packing systems or packaging systems for planar objects are well known in the art. For example, U.S. Pat. No. 4,892,193 discloses a packaging system comprising a container made from expanded plastic and having two parts, either two bottoms, a bottom and a lid, or two lids. The two parts are placed around the substantially planar object to be packaged and the two are joined together by sealing a strip of adhesive tape along and over their outside juncture. At least one impact strip of plastic foam may be provided to protect the planar object within the cavity of the container from damage by impact forces.

U.S. Pat. No. 3,939,978 discloses a shipping container for a stack of flat glass sheets. The container comprises a piece of corrugated fiberboard that is cut and scored to form a closed shipping container when folded. A resilient and compressible corner pad is provided at each corner of the stack to absorb shock.

As evidenced by the prior art discussed above, such packing systems generally require a multitude of components in order to provide the desired level of protection to the planar object. Moreover, a plurality of sizes of packing systems are required in order to adequately accommodate the various sizes of planar objects to be protected.

SUMMARY

The present invention overcomes the disadvantages of the prior art by providing a unitary foam packing element comprising a planar piece of foam that is precut with a plurality of score lines. In a preferred embodiment, the score lines define a first planar portion and a second planar portion, and the score lines enable the first planar portion to be folded over onto the second planar portion to thereby form a flat cavity between the first planar portion and the second planar portion. The score lines further define an end panel adjacent the second planar portion, with the end panel being adapted to be folded along a respective one of the score lines so as to form a first end wall of the flat cavity, and an intermediate portion between the first planar portion and the second planar portion, with the intermediate portion forming a second end wall of the flat cavity that is opposite the first end wall.

In another preferred embodiment, the score lines further define first and second side panels, and enable the first and second side panels to be folded along respective ones of the score lines so as to form side walls of the flat cavity. Further, the score lines define one or more openings in the single planar piece of foam, when the first planar portion is folded over onto said second planar portion, and one or more insert pieces that can be separated from the single planar piece of foam and inserted into the one or more openings to reduce an effective size of the flat cavity.

BRIEF DESCRIPTION OF THE FIGURES

These and other objects, features, and advantages of the present invention will become more readily apparent to those skilled in the art upon reading the following detailed description, in conjunction with the appended drawings.

DETAILED DESCRIPTION OF THE PREFERRED EMBODIMENTS

Figure 1:
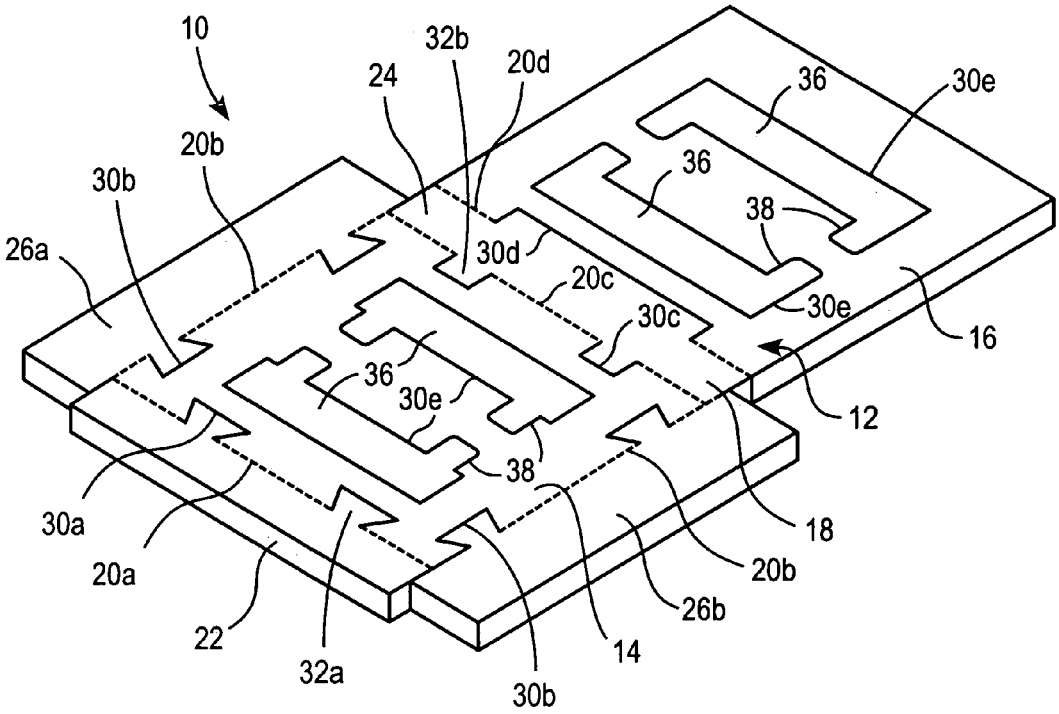
FIG. 1 is a perspective view of a packing system according to an embodiment of the present invention in a planar orientation.

The present invention is directed to a packing system for substantially planar articles, as shown generally by reference numeral 10 in FIG. 1. The packing system 10 comprises a base element 12 including a first planar portion 14, a second planar portion 16 and an intermediate portion 18 extending therebetween. The base element 12 includes a plurality of first score lines 20*a*, 20*b*, 20*c*, 20*d* and a plurality of second score lines 30*a*, 30*b*, 30*c*, 30*d*. As explained in greater detail below, the first score lines 20*a*, 20*b*, 20*c*, 20*d* do not extend entirely through base element 12, but rather, a slight thickness of material is left in tact such that a hinge is formed along the first score lines when the base element 12 is folded thereabout. On the other hand, second score lines 30*a*, 30*b*, 30*c*, 30*d* are preferably cut entirely through the base element 12 such that material may be entirely separated therefrom.

The first and second score lines 20*a*, 20*b*, 20*c*, 20*d*, 30*a*, 30*b*, 30*c*, 30*d* define a first end panel 22, a second end panel 24, and opposing side panels 26*a*, 26*b* extending from the first planar portion 14 of the base element 12. The intermediate portion 18 substantially defines the second end panel 24 between first planar portion 14 and second planar portion 16.

Figure 2:
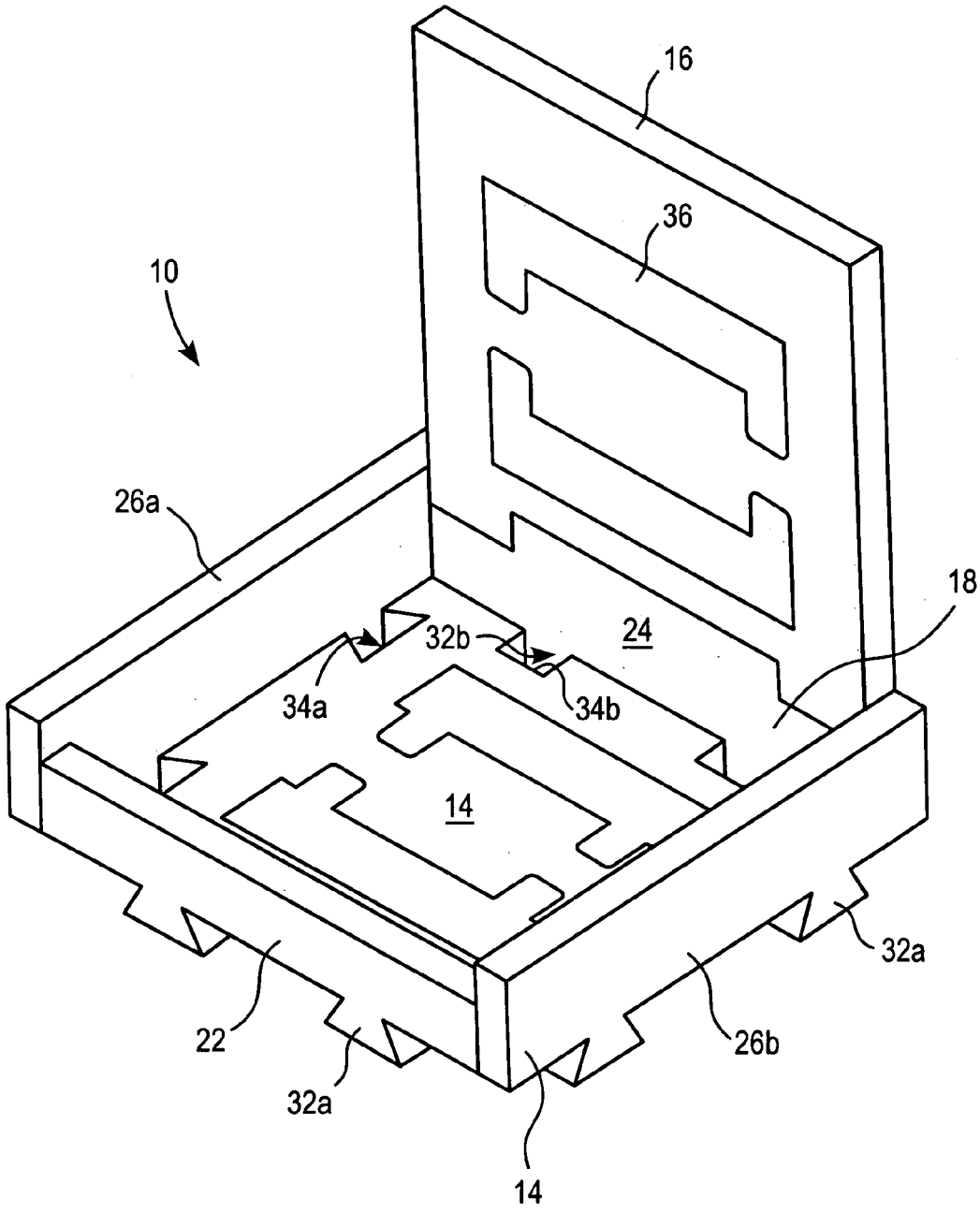
FIG. 2 is a perspective view thereof with the end and side walls folded upwardly to form a cavity.
Figure 3:
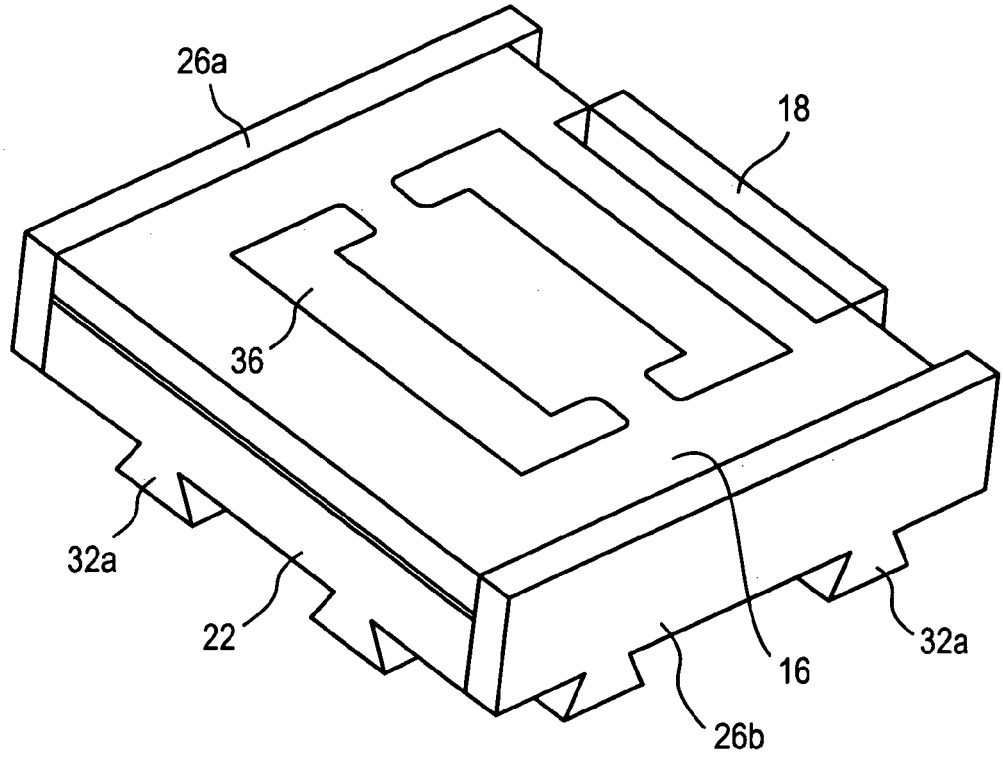
FIG. 3 is a perspective view thereof with the top portion folded on top of the bottom portion to thereby close the defined cavity.

Referring also to FIGS. 2 and 3, the first end panel 22 is folded about the first score line 20*a* so as to form a first upstanding end wall. Similarly, the side panels 26*a*, 26*b* are folded about second score lines 20*b* so as to form upstanding side walls for the packing system 10. In addition, the intermediate portion 18 defining the second end panel 24 is folded about the score line 20*c* so as to form a second end wall for the packing system 10. Due to the second score lines 30*a*, 30*b*, 30*c* extending entirely through the thickness of the base element 12, when the first and second end panels 22, 24 and side panels 26*a*, 26*b* are folded about the respective first score lines 20*a*, 20*b*, 20*c*, tab segments 32*a* in the first end panel and side panels and tab segments 32*b* in second end panel 24 are rotated downward as the walls are formed. As a result, tab openings 34*a*, 34*b* are thereby defined in the first planar portion 14, the purpose of which will be described in detail below.

As will be appreciated by one skilled in the art, although the illustrated embodiment discloses two tab segments and corresponding openings along each side of the cavity, only one tab may be utilized, or alternatively, more than two tabs may be utilized depending upon the size of the packing system, the particular foam material, and the desired end use. Similarly, while different shapes of tab segments and openings are illustrated, it should be apparent to one skilled in the art that all the tab segments and openings may be of similar shape, or that interlocking shapes differing from those illustrated may also be utilized.

The substantially flat cavity 28 defined by the first planar portion 14 and the upstanding side and end walls may further be enclosed by folding the second planar portion 16 about first score line 20*d* and second score line 30*d*. Thus, a protective packing system is easily formed for a planar article such as an LCD display screen, laptop computer, fragile plate, book, picture frame, or essentially any flat object. The packing system may further be placed in a conventional cardboard box for ease of handling and added protection from impact.

The base element 12 is preferably a single planar piece of material, preferably a foam material such as expanded polyethylene, expanded polypropylene or expanded polystyrene, for example. In each instance, the expanded foam material will have a preferred density ranging from 1 to 6 pounds per cubic foot, and more preferably, 1 to 2 pounds per cubic foot. The expanded polyethylene, and similarly the expanded polypropylene, may be used with or without a skin formation. In addition, the expanded polystyrene may be utilized with additional hinge thermoforming. Any combination of these materials can of course also be used, as would be apparent to one skilled in the art. Furthermore, the present invention is not limited to those materials.

Figure 4:
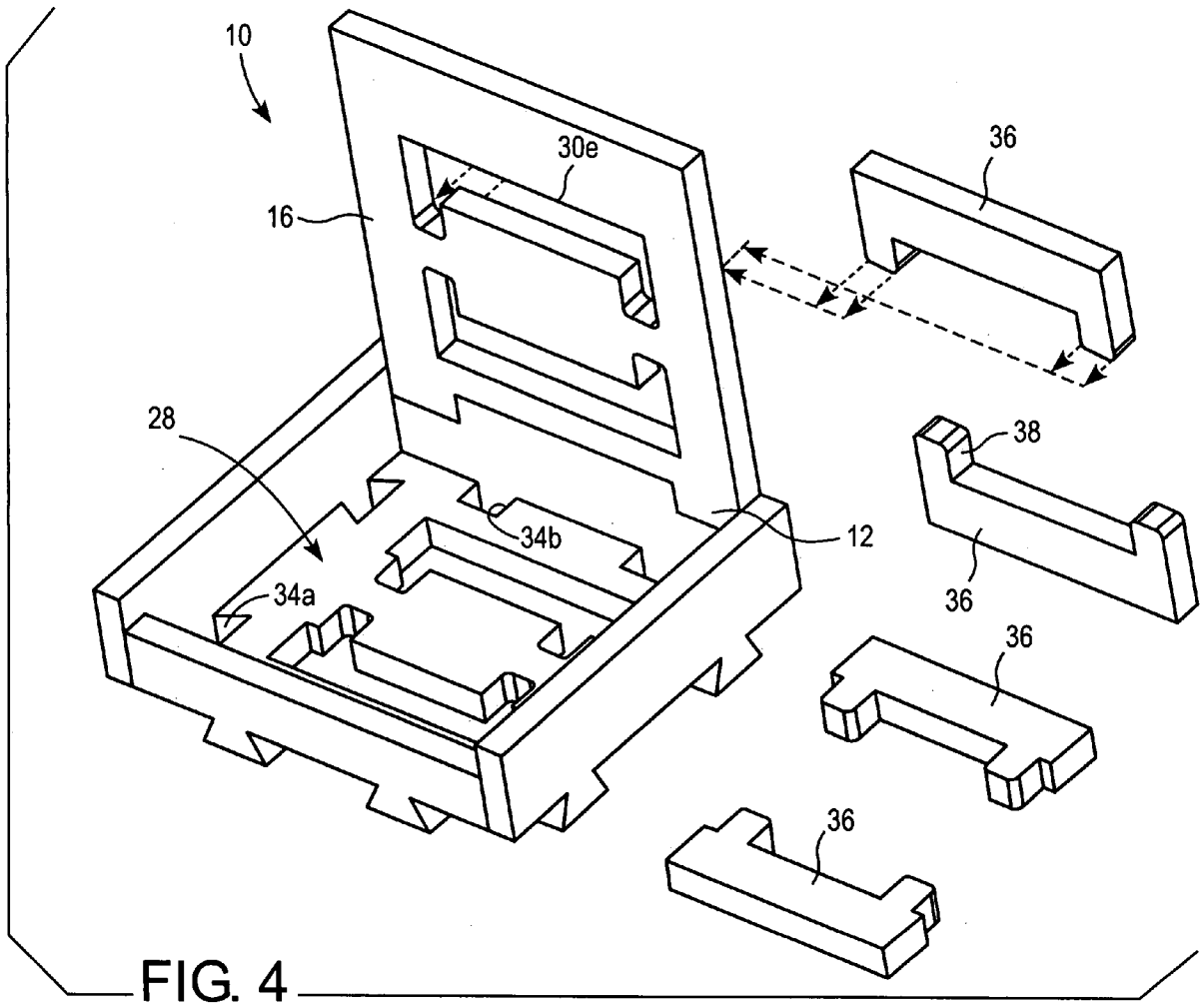
FIG. 4 is a perspective view similar to FIG. 2 illustrating the removable inserts having been removed from the base element.

Because flat objects such as LCD displays and the like, are not all made the same or similar size, the present invention also provides for adjustability in the size of the flat cavity 28 that is defined. Referring to FIG. 4, it is seen that the second score lines 30*e* define a plurality of insert elements 36 which may be removably secured within or removed from the base element 12. In a preferred embodiment, four such removable inserts 36 are provided, each having at least one tab element 38 extending therefrom.

Figure 5:
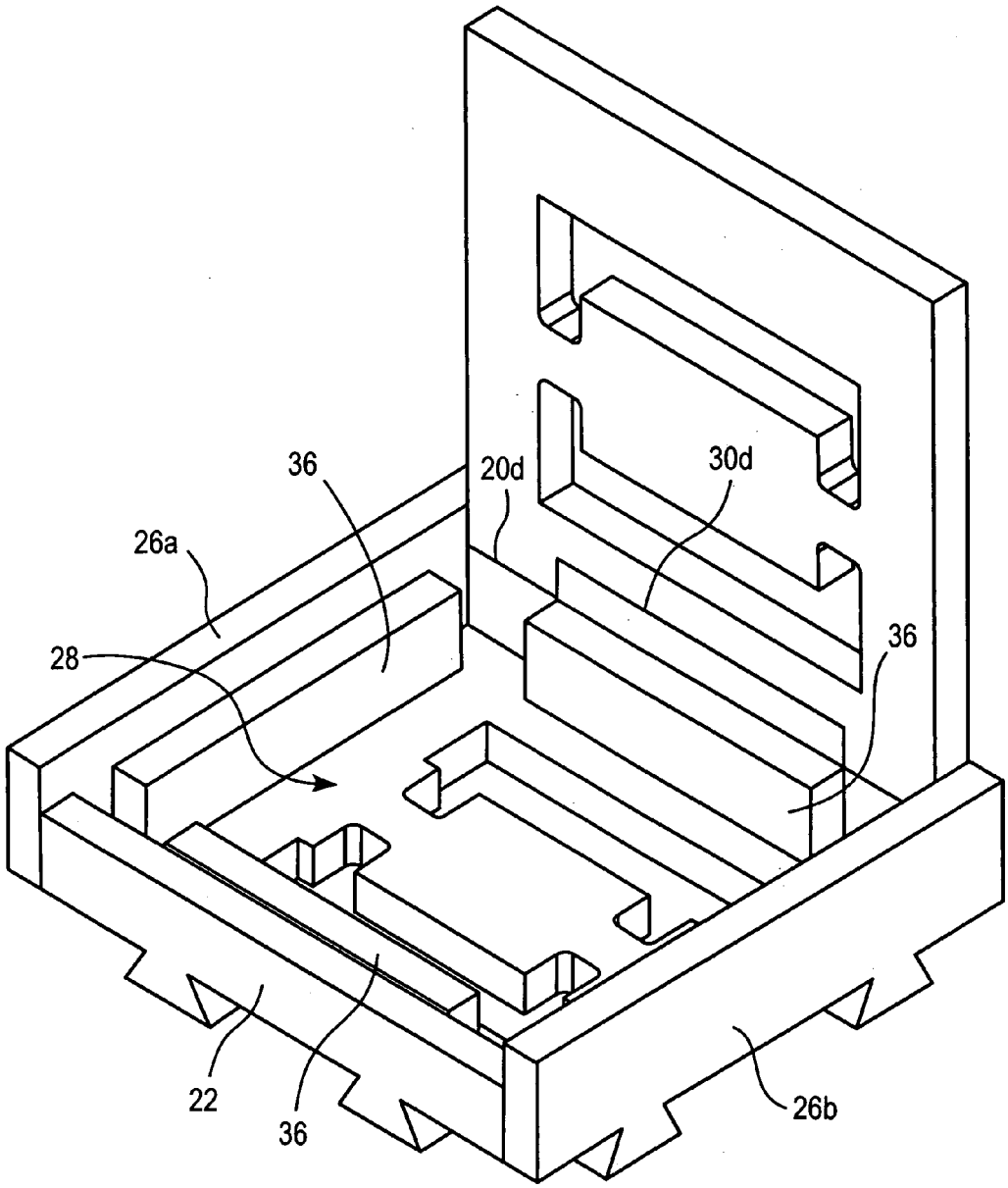
FIG. 5 is a perspective view thereof with the removable inserts disposed within the cavity to thereby reduce the size thereof.
Figure 6:
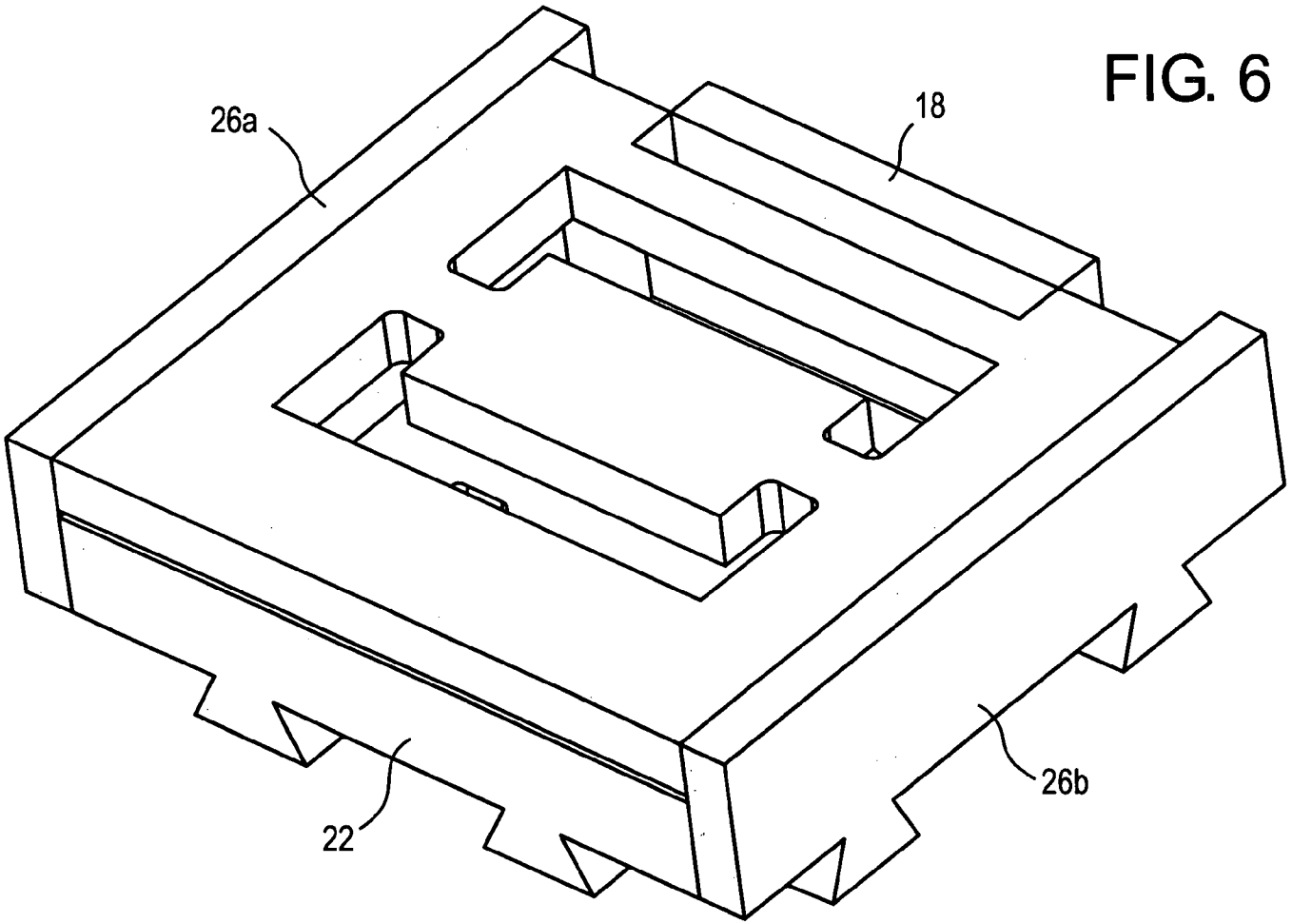
FIG. 6 is a perspective view thereof with the top portion with the removable inserts removed being folded onto the bottom portion of the base element.

As shown in FIG. 5, each of the removable inserts 36 may be disposed adjacent a respective one of the side walls and end walls defining the cavity 28. More particularly, the removable inserts 36 may be removably secured in place by engaging tab elements 38 within respective tab openings 34*a*, 34*b* in the base element 12. With the removable inserts 36 secured in place adjacent the side walls and end walls, the effective dimensions of the cavity 28 are thus reduced such that a smaller article may be securely and protectively contained within the packing system 10. As explained above, the second planar portion 16 may be folded down along score line 20*d* so as to define the top wall of the packing system for protecting the object within the flat cavity 28.

The present invention has now been described with reference to several embodiments thereof. The foregoing detailed description has been given for clarity and understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A unitary foam packing element, comprising:

a planar piece of foam, said piece of foam being precut with a plurality of score lines;

said score lines define a first planar portion and a second planar portion, said score lines enabling said first planar portion to be folded over onto said second planar portion to thereby form a flat cavity having a first predetermined perimeter defined between said first planar portion and said second planar portion; and said score lines further define an end panel adjacent the second planar portion, said end panel being adapted to be folded along a respective one of said score lines so as to form a first end wall of said flat cavity;

wherein, when said first planar portion is folded over onto said second planar portion, the score lines further define one or more openings in the single planar piece of foam; and wherein the score lines further define one or more insert pieces that can be separated from the single planar piece of foam and inserted into the one or more openings to thereby reduce an effective size of the flat cavity and define a second predetermined perimeter smaller than said first predetermined perimeter.

2. The unitary foam packing element of claim 1, wherein said score lines further define an intermediate portion between said first planar portion and said second planar portion, said intermediate portion forming a second end wall of said flat cavity that is opposite said first end wall.

3. The unitary foam packing element of claim 1, wherein the score lines further define first and second side panels, the score lines enabling the first and second side panels to be folded along respective ones of the score lines so as to form side walls of the flat cavity.

4. The unitary foam packing element of claim 3, wherein the score lines which define at least one of the first and second side panels include a tab creating segment so that when the at least one side panel is folded into the respective side wall, at least one cutout region opening exists adjacent the respective side wall.

5. The unitary foam packing element of claim 1, wherein said score lines defining said end panel include a tab creating segment so that when the end panel is folded so as to form the first end wall, at least one cutout region of the openings exists adjacent the first end wall.

6. A unitary foam packing element, comprising:

a single planar piece of foam which is precut with a plurality of score lines to define:

a first planar portion and a second planar portion, the score lines enabling the first planar portion to be folded over onto the second planar portion to form a flat cavity between the first planar portion and the second planar portion;

the score lines further defining an end panel adjacent the second planar portion, which end panel is adapted to be folded along a respective one of the fold lines so as to form a first end wall of the flat cavity;

the single planar piece of foam further including an intermediate portion between the first planar portion and the second planar portion, the intermediate portion forming a second end wall of the flat cavity that is opposite the first end wall when the first planar portion is folded over onto the second planar portion;

the score lines further defining first and second side panels, the score lines enabling the first and second side panels to be folded along respective ones of the score lines so as to form side walls of the flat cavity;

wherein the first and second end walls and the side walls of the flat cavity define a first predetermined cavity size:

each of the score lines defining the end panel and the side panels including at least one tab creating segment so that when the end panel is folded into the first end wall and when the side panels are folded into the side walls, at least one cutout region exists adjacent the first end wall and each of the side walls;

the score lines further define one or more insert pieces that can be separated from the single planar piece of foam and inserted into the one or more cutout regions to reduce an effective size of the flat cavity, and thereby defining, a second predetermined cavity size smaller than said first predetermined cavity size.

7. The unitary foam packing element of claim 6, wherein said plurality of score lines include a plurality of first score lines and a plurality of second score lines, said first score lines defining a cut through an entire thickness of said single planar piece of foam and said second score lines defining a cut through a portion of the thickness of said single planar piece of foam.

8. A method of forming a packing element from a single planar piece of foam which is precut with a plurality of score lines defining a first planar portion, a second planar portion, and an end panel adjacent the second planar portion, the method comprising:

folding the first planar portion over onto the second planar portion to form a flat cavity between the first planar portion and the second planar portion; and folding the end panel along a respective one of the fold lines so as to form a first end wall of the flat cavity;

wherein the score lines further define one or more insert pieces that can be separated from the single planar piece of foam, and further comprising separating the insert pieces from the single planar piece of foam, and inserting the insert pieces into the one or more cutout regions to reduce an effective size of the flat cavity.

9. The method of claim 8, further comprising forming a second end wall from an intermediate portion between the first planar portion and the second planar portion, the second end wall being opposite the first end wall.

10. The method of claim 9, wherein the score lines further define first and second side panels, and further comprising folding the first and second side panels along respective ones of the score lines so as to form side walls of the flat cavity.

11. The method of claim 10, wherein each of the score lines defining the end panel and the side panels including at least one tab creating segment, so that when the end panel is folded into the first end wall and when the side panels are folded into the side walls, at least one cutout region exists adjacent the first end wall and each of the side walls.

* * * * *